United States Patent [19]

Hagen

[11] Patent Number: 5,029,851

[45] Date of Patent: Jul. 9, 1991

[54] BALLOON POPPING APPARATUS

[76] Inventor: Elmer R. Hagen, 230 W. Genesee Street, Apt. 3, Auburn, N.Y. 13021

[21] Appl. No.: 503,902

[22] Filed: Apr. 4, 1990

[51] Int. Cl.[5] ..... A63F 9/00

[52] U.S. Cl. ..... 273/458; 273/86 R; 446/224

[58] Field of Search ..... 273/1 R, 1 G, 86 R; 446/220, 221, 224, 202, 181

[56] References Cited

U.S. PATENT DOCUMENTS

| | | | |
|---|---|---|---|
| 262,517 | 8/1882 | Unz et al. | 446/220 |
| 2,161,274 | 6/1939 | Behrend | 446/224 |
| 2,449,147 | 9/1948 | Samuels | 446/220 X |
| 4,453,711 | 6/1984 | Gin | 446/220 X |

FOREIGN PATENT DOCUMENTS

| | | | |
|---|---|---|---|
| 10660 | 4/1897 | United Kingdom | 446/220 |

*Primary Examiner*—Paul E. Shapiro
*Attorney, Agent, or Firm*—Katherine McGuire

[57] ABSTRACT

A toy for inflating and bursting a plurality of ballons and the like comprises an elongated, rigid tube having multiple air-inlet and air-outlet orifices with elongated, flexible tubing connected to each of the orifices. Valves connect to the free ends of the flexible tubing such that balloons attached to the end of some of the flexible tubing may be inflated and burst by a player or players blowing into the other flexible tubing. The rigid tube may be connected in series with other like, rigid tubes such that a plurality of players may participate.

4 Claims, 2 Drawing Sheets

BALLOON POPPING APPARATUS

BACKGROUND OF THE INVENTION

The present invention relates to games and, more particularly, to a hand-held game which may be played by one or more persons which involves orally blowing up releasably attached inflatable bodies of predetermined size, shape and color, and bursting them for amusement of the players and spectators alike.

A game which involves at least two players for orally blowing into a tube to inflate and break balloons may be seen in U.S. Pat. No. 4,453,711, for example, issued on June 12, 1984. The game seen in the '711 patent is intended for seated participants and comprises a supporting element or housing 3 having breaking elements 6 and 6'. The players orally blow into tubes connected to balloons within the housing and race against each other to see who can break their balloon first against the breaking element. The game apparatus of the '711 patent necessitates that it be placed and played on the top of a stationary horizontal surface. The '711 patent also fails to adequately explain how to arrange the apparatus so that more than two players can play at the same time.

OBJECTS OF THE INVENTION

It is a main object of the present invention to provide game apparatus for one or more players which is relatively compact and light-weight for ease of carrying by the participants so that they may walk or run together while playing the game.

It is another object of the present invention to provide a portable game for one or more players in which the players may attach various sized and shaped inflatable bodies to the game apparatus for bursting by orally blowing into air valves located a safe distance from the bursting objects.

It is a further object of the present invention to provide game apparatus for bursting inflatable objects for both audible and visual amusement, the game apparatus configured such that a plurality thereof may be quickly and easily placed and attached in series such that a potentially infinite number of players may participate.

Other objects will in part be obvious and in part appear hereinafter.

SUMMARY OF THE INVENTION

The game apparatus of the present invention is configured for use by one or two players. More than two players can play however, by attaching a plurality of game apparatus together in series, preferably two players per game apparatus.

Each game apparatus is comprised of a main length of rigid, hollow tubing which may be manually held and carried by the players. Two flexible, air-intake tubing segments smaller in diameter than the main tubing are attached substantially on opposite sides in the middle section of the main tubing. Air valves or mouth pieces may be attached to the free ends of the flexible tubing for blowing into by the players. A pair of air valves are located approximately midway between a first, front end of the main tubing and the air-intake tubings. Flexible tubing segments are attached to these air valves on a first of their ends and the second of their ends include valve stems for attaching relatively small sized balloons or other similarly sized, inflatable bodies.

The front end of the main tubing tapers inwardly such that it may be readily telescopically fit into and secured to the second, back end of a like game apparatus. In this way, a plurality of such game apparatus may be attached in series such that a plurality of players may play at the same time. The back end of the game apparatus is provided with a releasably attached lid for use when one game apparatus is used by itself such that the inside of the main tubing may be maintained at an increased pressure when used in the intended manner.

The tapered, front end of the main tubing is adapted to receive a long length of flexible tubing such as the tubing attached to the air valves and small balloons. A valve fitting is attached to the free end of this front end flexible tubing for receiving a relatively large balloon or other inflatable object.

Many various games are envisioned which may be played with the game apparatus herein described by using uniquely shaped inflatable objects in addition to standard balloons and by combining the use of the present game apparatus with other playing apparatus.

DETAILED DESCRIPTION

Figure 1:
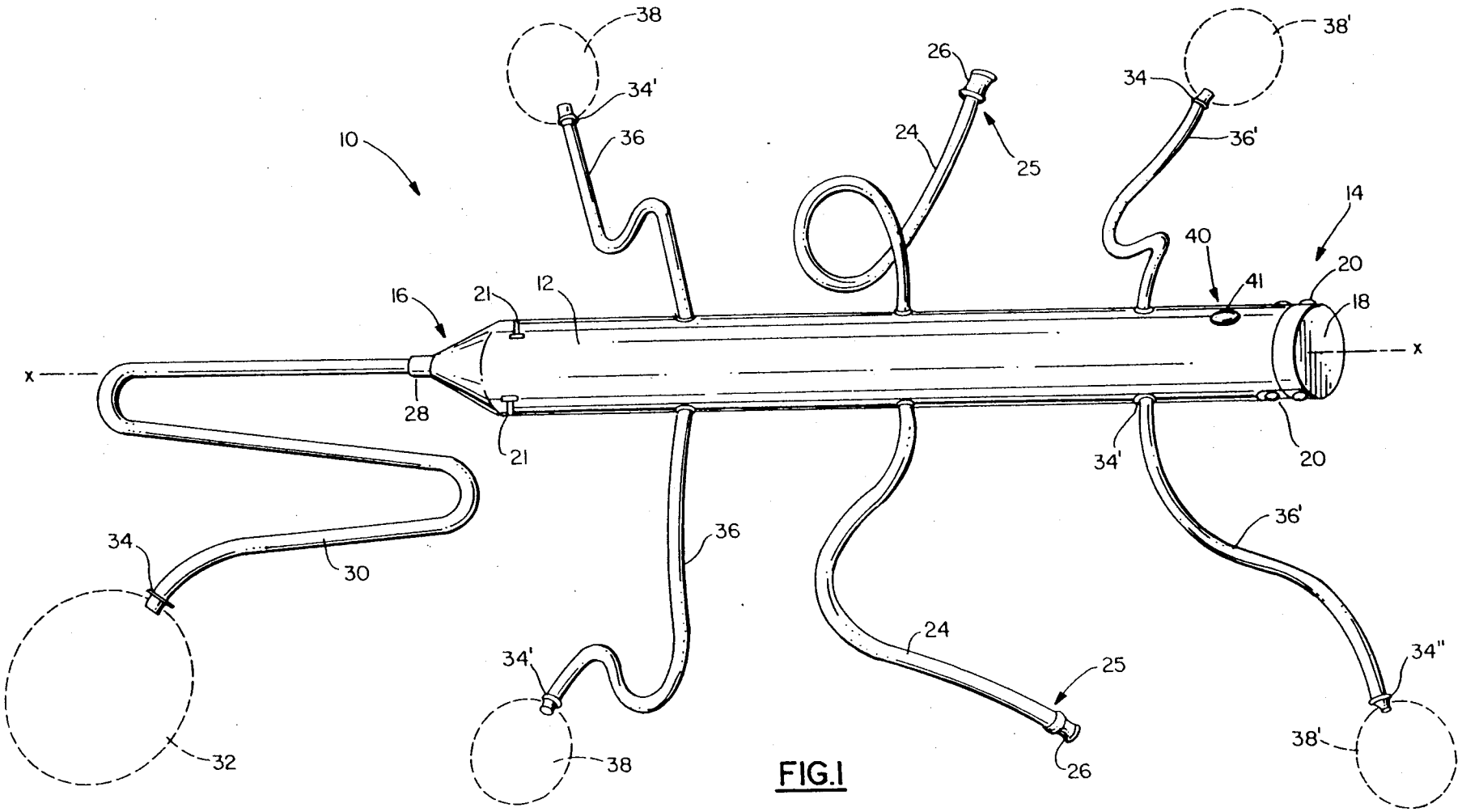
FIG. 1 is a perspective side view of the game apparatus.

Referring now to the drawing, there is seen in FIG. 1 the game apparatus of the present invention designated generally by the numeral 10.

The balloon popping apparatus comprises a main length of tubing 12 having a through, axial bore and is preferably approximately 27 inches in length and 2 to 4 inches in diameter along its widest points. Main tubing 12 is preferably constructed of a rigid plastic, such as PVC, for example, and is thus adapted for manual grasping by the players. Tubing 12 includes a first, back end portion and a second, front end portion, both designated generally by the reference numerals 14 and 16, respectively. Back end 14 includes a releasable covering cap 18 which may be secured to end 14 by clamps 19, it being desirable to seal normally open end 14 when apparatus 10 is used by itself, i.e., when it is not attached to a second apparatus 10, as described below, such that the inner cavity of tubing 12 can be maintained at an increased pressure during operation. Flexible tubing 24 is attached to and extends from opposite sides of main tubing 12 each tubing 24 being preferably approximately 12" in length and ½" in diameter. One-way valves or mouth pieces 26 are releasably attached to the open, free ends 25 of flexible tubing 24 such that valves 26 communicate with the internal bore of tubing 12. The players orally blow into valves 26, holding tube 12 with one hand and tubing 24 with the other hand while facing the front end 16 of apparatus 10.

Front end 16 of tubing 12 tapers symmetrically inwardly about central axis x—x, terminating at outlet tip 28. A first end of flexible tubing 30 is releasably attached to tip 28 such that it communicates with the inside bore or cavity of tubing 12. A large, inflatable object such as balloon 32 is attached via a one-way blow stem 34 to the opposite, free end of tubing 30. It is contemplated that tubing 30 may be up to about 10 feet in length and still be effective for players to blow up balloon 32 and burst it by blowing into stems 26 to create both a visual and audible display for the enjoyment of the players and spectators alike.

Additional tubing for bursting a plurality of inflatable objects is shown by reference numerals 36, 36' and 38, 38', respectively. As is shown in FIG. 1, it is preferable that balloons 38, 38' or other inflatable objects are somewhat smaller in size than balloon 32, making balloon 32 the center of attraction for the players and spectators. It is also an object for the players to blow up and burst balloons 38, 38' while trying to burst balloon 32. As seen, flexible tubing 36, 36' are attached to tubing 12 in the same manner previously described for tubing 24, the pair of flexible tubing 36 being located on substantially opposite sides of tubing 12 and approximately midway between front end 16 and ends 22 of tubing 24 and the pair of flexible tubing 36' being located on substantially opposite sides of tubing 12 and approximately midway between back end 14 and ends 22. Balloons 38, 38' are connected to tubing 36, 36' via one-way valve stems 34', 34" such that air accummulated inside tubing 12 may forcefully pass through tubing 36, 36' and inflate balloons 38, 38' yet not allow any air to travel in the reverse direction.

Figures 2, 3:
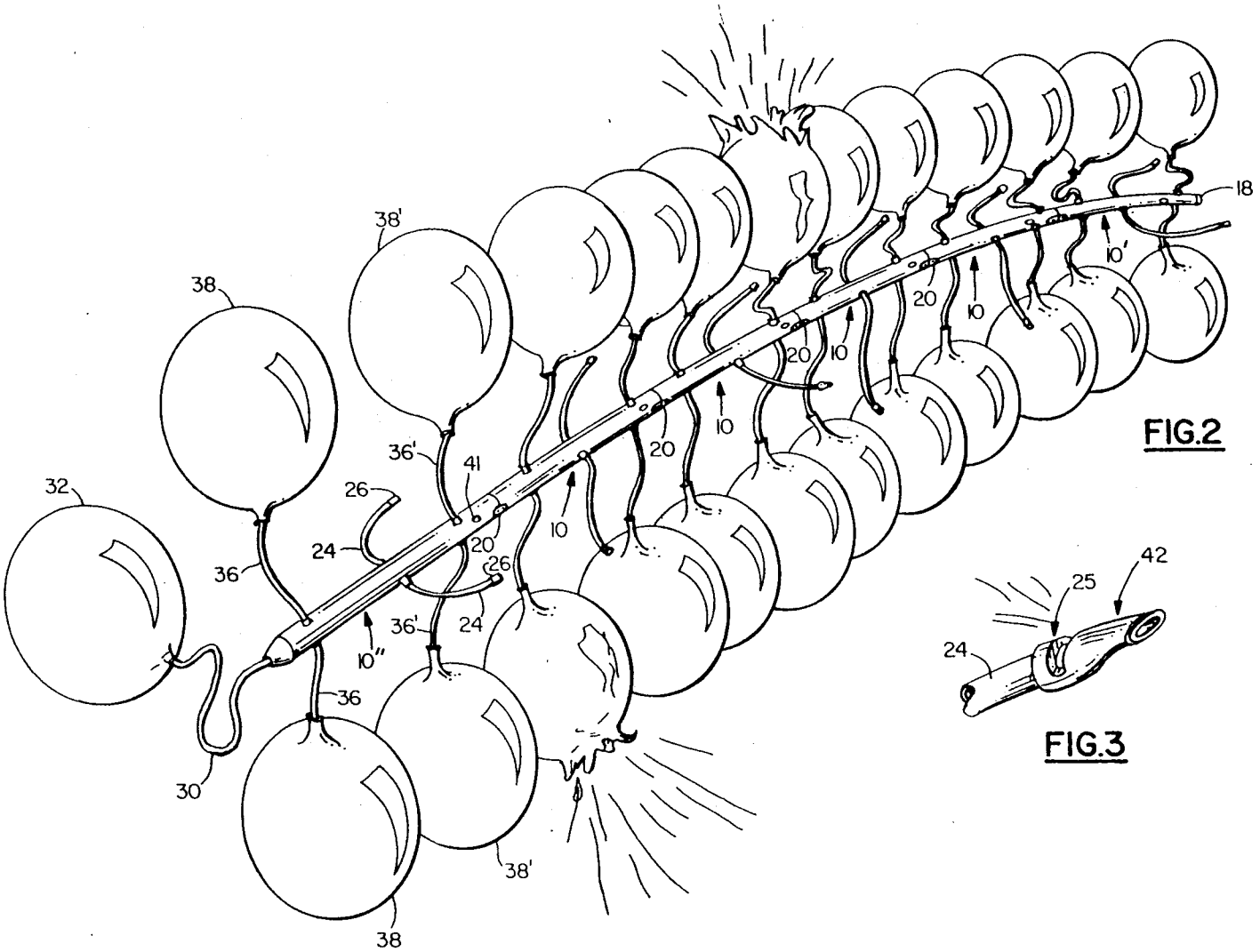
FIG. 2 is a perspective view of a plurality of the apparatus seen in FIG. 1 attached in series.
FIG. 3 is a perspective view of a conventional whistle for releasable attachment to the game apparatus of FIGS. 1 and 2.

Tubing 12 further includes air-outlet port 40 including releasable cap 41 for allowing air, which has been built up inside tubing 12 by the players, to escape when desired. After bursting of balloons 32, 38, and 38' has been accomplished, a new set of balloons or other inflatable bodies may be attached to stems 34, 34' and 34" for continuing play. As seen in FIG. 3, a conventional whistle 42 may optionally be attached to end 25 of tubing 24 for a player to make an audible whistling sound in place of or at the same time as blowing up balloons 32, 38 and 38'.

As seen in FIG. 2, a plurality of game apparatus 10 may be attached in series for conceivably an infinite number of players to play with. To attach one apparatus to another, covering cap 18 is removed from back end 14 by disengaging clamps 20. The front, tapered end 16 of another apparatus 10 is then inserted into back end 14 absent the tubing 30 and balloon 32. The two apparatus are then secured together by engaging clamp 20 to clamp receiving means 21 located adjacent front end 16 along the non-tapered portion of tubing 12. Many such apparatus 10 may be attached in series in this way, six such apparatus 10 being shown attached in FIG. 2. It is only necessary that the back-most apparatus 10' include covering cap 18 to maintain the bores or inner cavities of the tubings 12 at an increased pressure, and that the forward-most apparatus 10" include tubing 30 and balloon or other inflatable object 32. Although no players are shown in the various drawings for purposes of clarity, it should be apparent that they would stand along opposite sides of the apparatus 10, two per apparatus. Two balloons are shown bursting in FIG. 3, as intended.

What is claimed is:

1. Apparatus for inflating and bursting at least one inflatable body comprising:

a.) an elongated, rigid tube of a first, substantially constant diameter having an axial bore, said tube having first and second ends wherein said second end tapers inwardly in a direction away from said tube and about said axis to form a first air-outlet orifice:

b.) a cover of substantially the same diameter as said first diameter;

c.) means to releasably attach said cover to said tube first end whereby said tube first end may be made air-tight;

d.) a first length of flexible tubing having first and second ends, said first length of tubing first end attached to said first air-outlet orifice;

e.) a first one-way air pressure valve having first and second ends, said valve first end attached to said first length of tubing second end wherein a first of said at least one inflatable bodies may be attached to said valve second end;

f.) a first air-inlet orifice on said rigid tube located between said tube first and second ends;

g.) a second length of flexible tubing having first and second ends, said second length of tubing first end attached to said first air-inlet orifice;

h.) a first air-intake valve having first and second ends, said air-intake valve first end attached to said second length of tubing second end wherein said air-intake valve second end may be orally blown into repeatedly whereby air forced through said air-intake valve passes through said second length of tubing and into said axial bore and into said first length of tubing, through said first, one-way air pressure valve to inflate said first of said at least one of said inflatable bodies.

2. The invention according to claim 1 and further comprising:

a.) a second air-outlet orifice on said rigid tube located between said first air-outlet orifice and said first air-inlet orifice;

b.) a third length of flexible tubing having first and second ends, said third length of tubing first end attached to said second air-outlet orifice; and c.) a second one-way air pressure valve having first and second ends whereby air may flow from said second one-way air pressure valve first end to said second one-way air pressure valve second end, said second one-way air pressure valve first end attached to said third length of tubing second end whereby a second of said at least one of said inflatable bodies may be attached to said second one-way air pressure valve second end such that air in said tube may flow through said third length of tubing and through said second one-way air pressure valve to inflate said second of said at least one of said inflatable bodies.

3. The invention according to claim 2 and further comprising:

a.) a third air-outlet orifice on said rigid tube between said first air-outlet orifice and said tube first end;

b.) a fourth length of flexible tubing having first and second ends, said fourth length of tubing first end attached to said third air-outlet orifice; and c.) a third one-way air pressure valve having first and second ends whereby air may flow from said third one-way air pressure valve first end to said third one-way air pressure valve second end, said third one-way air pressure valve first end attached to said fourth length of tubing second end whereby a third of said at least one of said inflatable bodies may be attached to said third one-way air pressure valve second end such that air in said tube may flow through said fourth length of tubing and through said third one-way air pressure valve to inflate said third of said at least one of said inflatable bodies.

4. The invention according to claim 3 and further comprising means to attache said second end of a first of said rigid tubes to said first end of a second of said rigid tubes whereby said axial bore of said first of said rigid tubes communicates with said axial bore of said second of said rigid tubes.

* * * * *